US011337874B2

(12) United States Patent
Sjogren et al.

(10) Patent No.: US 11,337,874 B2
(45) Date of Patent: May 24, 2022

(54) ASSISTIVE SEATING DEVICE

(71) Applicant: LP4, LLC, Tuscaloosa, AL (US)

(72) Inventors: Olof Hakan Sjogren, Ydre (SE); Jakob Carl Erik Sjogren, Stockholm (SE)

(73) Assignee: LP4, LLC, Tuscaloosa, AL (US)

( * ) Notice: Subject to any disclaimer, the term of this patent is extended or adjusted under 35 U.S.C. 154(b) by 427 days.

(21) Appl. No.: 15/933,528

(22) Filed: Mar. 23, 2018

(65) Prior Publication Data

US 2019/0290519 A1 Sep. 26, 2019

(51) Int. Cl.

*A61G 7/10* (2006.01)
*A61G 5/14* (2006.01)
*A61G 5/10* (2006.01)

(52) U.S. Cl.

CPC ..... *A61G 7/1007* (2013.01); *A61G 5/104* (2013.01); *A61G 5/14* (2013.01); *A61G 7/1038* (2013.01)

(58) Field of Classification Search

CPC ..... A47K 13/10–105; A61G 7/10; A61G 7/1007; A61G 7/1019; A61G 5/14; A61G 5/125; A61G 5/1002

See application file for complete search history.

(56) References Cited

U.S. PATENT DOCUMENTS 4,519,649 A * 5/1985 Tanaka ..... A61G 5/14 297/316
4,587,678 A * 5/1986 Love ..... A47K 17/026 297/330
4,632,455 A * 12/1986 Schiller ..... A61G 5/14 297/183.9
4,833,736 A * 5/1989 Sadler ..... A61G 7/1007 4/254
4,884,841 A * 12/1989 Holley ..... A61G 5/14 297/331
5,189,739 A * 3/1993 Thierry ..... A47K 13/28 4/237
5,465,744 A * 11/1995 Browning ..... A61G 7/053 135/67
6,035,462 A * 3/2000 Bennett ..... A61G 7/1007 4/254

(Continued)

FOREIGN PATENT DOCUMENTS

WO WO2013187819 * 12/2013 ..... A61G 5/14

*Primary Examiner* — David P Angwin
*Assistant Examiner* — Nicholas A Ros
(74) *Attorney, Agent, or Firm* — Baker Donelson Bearman Caldwell & Berkowitz, PC

(57) ABSTRACT

An assistive seating device (10) includes a frame (11) having a base (12) with rear legs (14) coupled to front legs (15) having lifting arms (21). The base also includes a first couplers (25) and second couplers (26). The frame also includes a seat portion (29) coupled to the base for reciprocal movement between a lowered, seating position and a raised, lifting position. Lifting cylinders (40) are pivotally coupled at a top end (41) to the seat portion. Each lifting cylinder also has a lower end (44) receivable within either the first or second tubular coupler. The force of the lifting cylinders upon the pivoting seat portion depends upon the selected coupling location of the lower ends of the lifting cylinders upon the base. The assistive seating device also includes a lock to prevent the seat portion from pivoting from its lowered, seating position to its raised, lifting position.

8 Claims, 5 Drawing Sheets

(56) References Cited

U.S. PATENT DOCUMENTS

| | | | | |
|---|---|---|---|---|
| 6,189,164 | B1 * | 2/2001 | Krapu | A61G 5/14 297/313 |
| 6,449,783 | B1 * | 9/2002 | Moser | A47K 13/10 4/254 |
| 6,945,604 | B2 * | 9/2005 | Splane, Jr. | A61G 5/14 297/313 |
| D594,946 | S * | 6/2009 | Gilbert | D23/311 |
| 2006/0048296 | A1 * | 3/2006 | Sutou | A61G 7/1007 4/667 |
| 2009/0307832 | A1 * | 12/2009 | Pereira Del Arroyo | A47K 17/026 4/254 |

* cited by examiner

ASSISTIVE SEATING DEVICE

TECHNICAL FIELD

This invention relates generally to a seating device, and more particularly to an assistive seating device.

BACKGROUND OF INVENTION

People routinely sit upon a seating device during the entire course of a day. These seating devices may include dinning room chairs, seating area chairs, car seats, and toilets. These seating devices are designed so that a person simply moves from a standing position to a seated position, or visa-versa, using one's leg muscles. However, a problem may arise when the person moves from the seated position to the standing position due to health issues, such as old age, illness, a disability, weakness in the legs or knees, or an overall lack of strength. This may be particularly prevalent when the seating surface of the seating device is low to the floor thereby requiring a greater effort to move to a standing position, such as the case with toilet seats.

In the past, chairs have used mechanical means to raise and/or tilt the seating area as the person moves to a standing position. While this type of chair is an aid, they are complicated to design and manufacture, they are large is size and heavy in weight, they are not practical for small seating areas, and they are not easily retrofitted to an existing seat.

To aid with small seating areas, such as a toilet seat, devices have been designed to tilt the seating area, as such in U.S. Pat. No. 6,067,674. This toilet seat utilizes energy storing supporting struts to force the toilet seat to tilt upwardly and forwardly, thereby forcibly moving the person towards a standing position. However, these devices are not easy to mount to and later dismount from a toilet. Another problem with this type of device is that each energy storing support strut used to lift the seat must be placed at the same selective position, otherwise the seat will tilt.

Similar devices have also been designed for use with toilets and the like which include support arms coupled to the lifting seat. The mounting of the support arms to the tilting seat makes it difficult for a person to use their arms in lifting themselves from a seated position as the downward pressure on the armrests counters the upward movement of the toilet seat.

Accordingly, there is a need in the art for an assistive seat device that will aid a person in rising from a seated position to a standing position while allowing them to use their arms during the process. It is to the provision of such therefore that the present invention is primarily directed.

SUMMARY OF THE INVENTION

In a preferred form of the invention an assistive seating device comprises a base having a front and a rear, including a pair of laterally disposed first couplers positioned adjacent the stationary base rear, and a pair of laterally disposed second couplers positioned adjacent the stationary base front. The stationary base also includes a pair of laterally disposed stationary arms. The assistive seating device also has a seat portion pivotally coupled for reciprocal movement to the stationary base. The seat portion includes a pair of laterally disposed pivot mounts. The assistive seating device also has a pair of laterally disposed lifting cylinders wherein each lifting cylinder has one end pivotally coupled to the seat portion through one pivot mount and an opposite end releasably coupled to either one of the first couplers or one of the second couplers. With this construction, the selective positioning of the lifting cylinders through the selective positioning of the opposite ends determines the lifting force of the lifting cylinders upon the seat portion.

DETAILED DESCRIPTION

Figure 1:
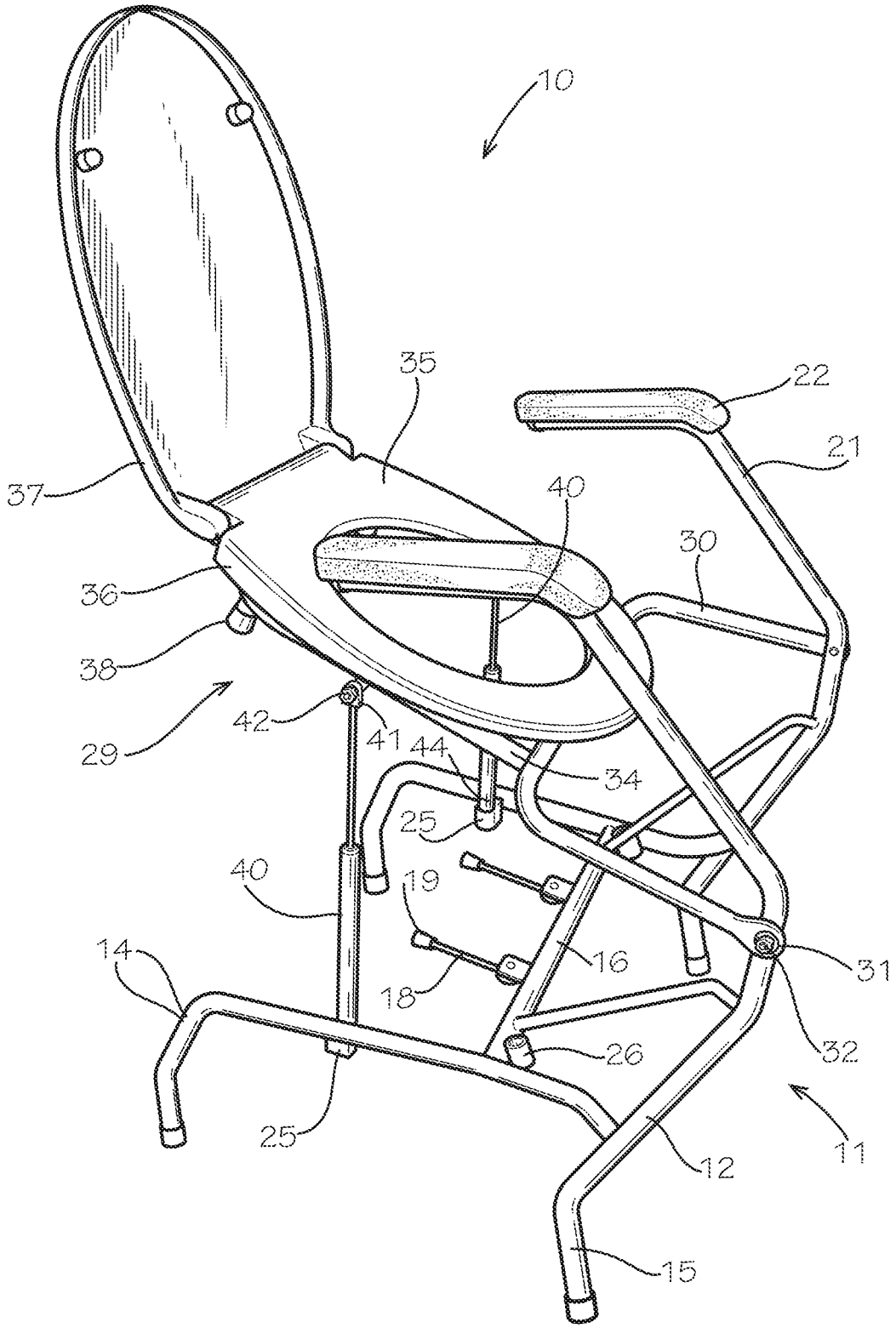
FIG. 1 is a perspective view of an assistive seating device embodying principles of the invention in a preferred form.

With reference next to the drawings, there is shown an assistive seating device 10 according to the present invention. It is to be appreciated that the assistive seating device 10 shown in FIGS. 1-5 of the drawings is configured for use in conjunction with a conventional toilet.

The assistive seating device 10 includes a frame 11 having base 12 with a pair of rear legs 14 coupled to a pair of front legs 15 and a cross-bar 16 coupled to and extending between the pair of rear legs 14. Each front leg 15 extends upwardly to form a lifting arm or armrest base 21. A padded armrest 22 is mounted to each armrest base 21 in a position to aid a person in raising from a seated position to a standing position. A pair of toilet position stops 18 is pivotally mounted to the cross-bar 16 so that each may be moved between a stowed position closely adjacent the cross-bar 16 and an extended position generally normal to the cross-bar 16. Each toilet position stop 18 includes a soft rubber end piece 19.

The base 12 also includes a pair of first or rear tubular or cup-shaped couplers 25 positioned adjacent to or towards the rear of the base 12, and a pair of second or front tubular or cup-shaped couplers 26 positioned adjacent to or towards the front of the base 12. The pairs of rear legs 14, front legs 15, armrest bases 21, first coupler 25 and second couplers 26 are all laterally offset or disposed so that one item of each pair is located on each lateral side of the assistive seating device, i.e., one item on each side.

Figure 2:
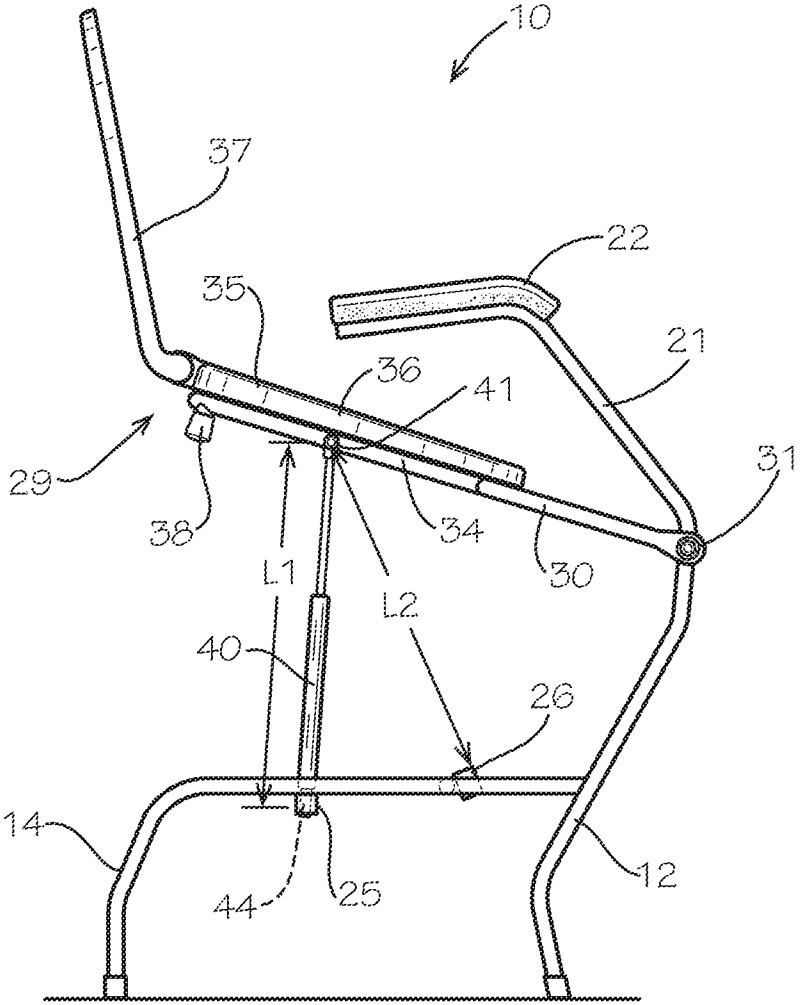
FIG. 2 is a side view of the assistive seating device of FIG. 1, shown in a first configuration.
Figure 5:
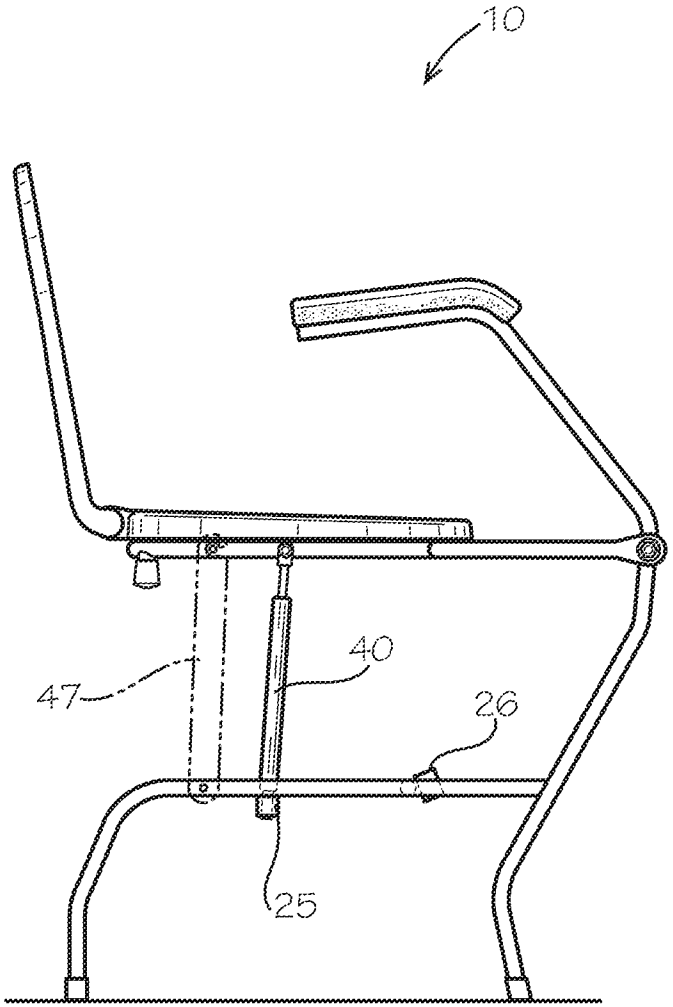
FIG. 5 is a side view of the assistive seating device of FIG. 1, shown in a lowered or seated position.

The frame 11 also includes a seat portion 29 pivotally coupled to the base 12 for reciprocal movement between a lowered, seating position, shown in FIG. 5, and a raised, lifting position, shown in FIGS. 1 and 2. The reciprocating seat portion 29 includes a first U-shaped member 30 having ends 31 pivotally coupled to the armrest base 21 through pivot bolts 32. A second U-shaped member 34 extends from the first U-shaped member 30. A conventional toilet seat 35 is mounted to the second U-shaped member 34. The toilet seat 35 includes the typical rim 36 and pivoting lid 37. A pair of soft rubber stops 38 depend from the second U-shaped member 34. The rubber stops 38 are positioned so that they come to rest upon the rim of a toilet when the seat portion 29 is in its lowered, seating position, thereby providing support and resisting sliding movement of the device 10 upon an underlying floor.

Figure 3:
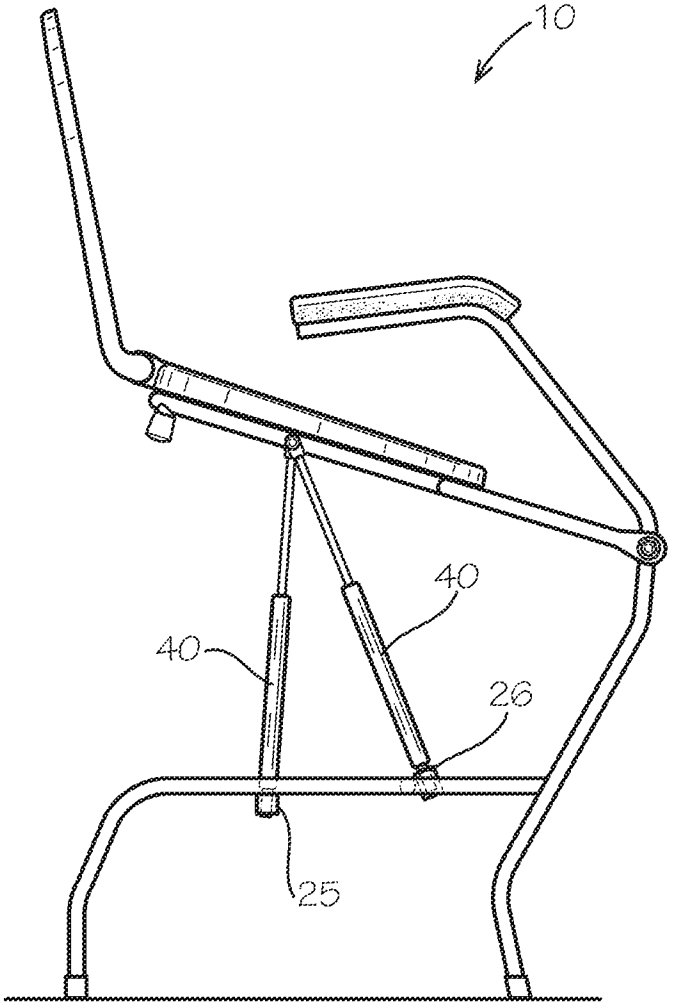
FIG. 3 is a side view of the assistive seating device of FIG. 1, shown in a second configuration.

A pair of lifting devices or lifting cylinders 40 is pivotally coupled at a top or upper end 41 to the second U-shaped member 34 of the seating portion 29 through a pair of pivot bolts 42. Each lifting cylinder 40 also has a bottom or lower end 44 with a cylindrical shape to be selectively and releasably received within the first or second tubular coupler 25 or 26. The lifting cylinders 40 may be in the form of spring loaded devices, gas springs, pneumatic cylinders, hydraulic cylinders, or the like. The term lifting device or lifting cylinder is intend to denote any type of device which may exert a force used to lift the seat portion, and it not limited to devices with actual cylinders. One example of such as lifting cylinder is a gas spring sold as model number BONO-00-150-365-001 by Bansbach Easylift Of North America, Inc. of Melbourne, Fla. The lifting cylinders 40 provide an upward lifting force upon the pivoting seat portion 29 so as to move it from the lowered, seating position towards and to the raised, lifting position. The strength or force of the lifting cylinders 40 upon the pivoting seat portion 29 depends upon the selected coupling location of the lower ends 44 of the lifting cylinders 40 upon the base 12, disregarding the inherent selected force designed into each lifting cylinder. The lifting cylinder lower ends 44 may both be selectively coupled to be both received into the first tubular couplers 25, as shown in FIG. 2, may have one lifting cylinder lower end 44 positioned in the first tubular coupler 25 and the other lifting cylinder lower end 44 positioned in the second tubular coupler 26 (staggered), as shown in FIG. 3, or may be both received into the second tubular couplers 26, as shown in FIG. 4.

The assistive seating device 10 may also include a lock to prevent the seat portion 29 from pivoting from its lowered, seating position to its raised, lifting position. The reason for the lock is to prevent the unwanted tilting or raising of the seat portion 29 when such a lifting force is not desired. The lock may be a simple moveable catch 47 extending between the base 12 and the seat portion 29, or it may be a catch which is moved into place through a handle coupled to the arm rest base 21 which moves the catch through a conventional pull wire extending along the frame 11.

In use, the position of the lifting cylinders 40 determine the strength or lifting force placed upon the pivoting seat portion 29. The lower ends 44 of both lifting cylinders 40 may be slid into or received into the first tubular couplers 25, as shown in FIG. 2. Here, the orientation of the lifting cylinders is generally vertical when the seat portion 29 is in its lowered, seating position. The generally vertical orientation of both lifting cylinders 40 provides the maximum lifting force upon the seat portion 29.

Figure 4:
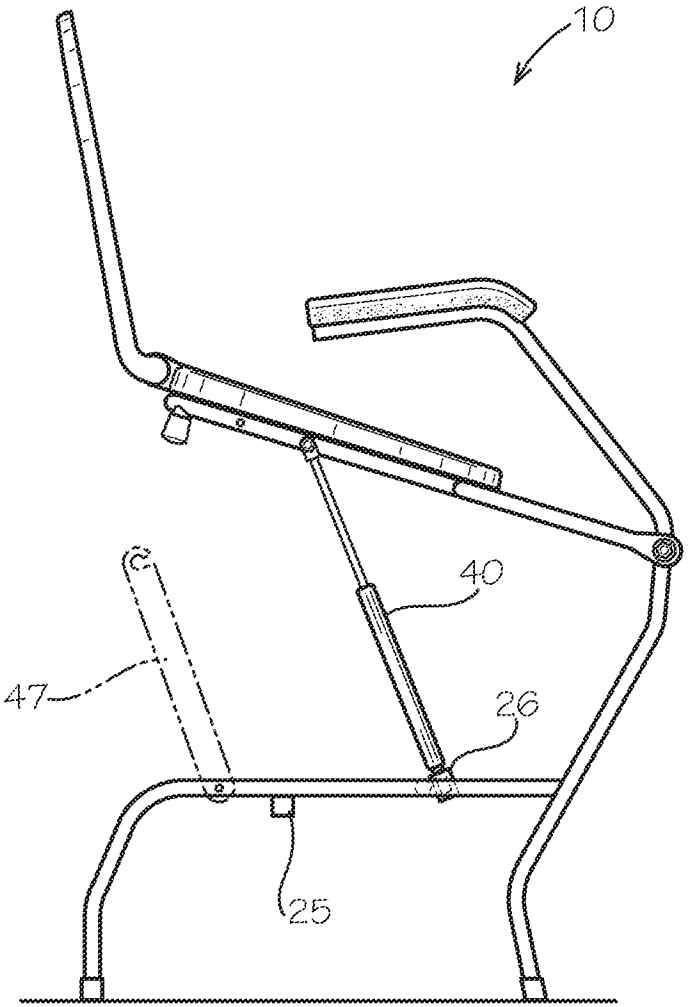
FIG. 4 is a side view of the assistive seating device of FIG. 1, shown in a third configuration.

Alternatively, the lower ends 44 of both lifting cylinders 40 may be slid into or received into the second tubular couplers 26, as shown in FIG. 4. Here, the orientation of the lifting cylinders is generally at an elevational angle offset from the vertical, which diminishes the vertical lifting or tilting force upon the seat portion 29, as a portion of the cylinder's force is directed in the horizontal direction.

As another alternatively, the lower end 44 of one lifting cylinder 40 may be slid into or received into the first tubular coupler 25 while the lower end 44 of the other or opposite lifting cylinder may be slid into or received into the second tubular coupler 26, as shown in FIG. 3. This staggering of the lifting cylinders 40 creates an overall lifting or tilting force upon the seat portion 29 which is less than the force created when both lifting cylinders 40 are mounted to the first tubular couplers 25 but greater than the force created when both lifting cylinders 40 are mounted to the second tubular couplers 26, i.e., it creates an intermediate lifting force. Thus, the three possible configurations of the lifting cylinders 40 creates three different amounts of lifting force so as to accommodate people of different weights and/or physical strengths.

It should be understood that the distance between the top pivot bolts 42 and the first tubular couplers 25 is essentially the same as the distance between the top pivot bolts 42 and the second tubular couplers 26. By maintaining the same distances the lifting cylinders 40 may be mounted to different couplers (25 and 26) in a staggered configuration without causing a sideways tilting of the seat to one side due to the lifting cylinders being coupled at different lengths. Therefore, the term substantially or generally the same length or distance, as used herein, is intended to denote a length or distance which is close enough so as not to cause a tilting of the seat portion due to the lifting cylinders being set at different lengths. This is great advantage over devices of the prior art which required both cylinders to be mounted at the same selected position.

Once the relative strength of the assistive seating device is determined through the positioning or elevational angles of the lifting cylinders, the assistive seating device 10 is moved to a position in front of and about a conventional toilet, so that the toilet seat 35 is positioned generally at the same location as that of the conventional toilet seat. It should be understood that the device 10 may be used with a conventional toilet wherein the seat has been removed, or with a conventional toilet wherein the seat is still mounted thereon, in which case the device toilet seat 35 is positioned above or in register with the conventional toilet seat. In positioning the assistive seating device 10, the toilet position stops 18 are extended so that their end pieces 19 abut the bottom portion of the toilet and thereby prevent further movement of the device.

With the assistive seating device 10 properly positioned, a person back up to the seat portion 29 while in its raised, lifting position (shown in FIGS. 1 and 2). The person may then shift his or her weight to the toilet seat 35, thereby causing the seat portion 29 to move or lower from the raised, lifting position to the lowered, seating position. The lowering movement of the seat portion 29 loads the lifting cylinders 40 to create a force for later aiding in the lifting of the seat portion 29 and person.

When a person sitting on the lowered seat portion 29 intends to move to a standing position, that person simply leans forward from the waist and/or attempts to raise himself or herself to a standing position. The reduction of weight upon the seat portion 29 allows the force of the lifting cylinders 40 to push or force the person upwardly to a standing position, or at least aid in doing so. Also, the person is able to push downwardly upon the arm rest to aid in the lifting process without affecting the movement or force of the seat portion 29. As such, the person may utilize both his or her leg strength as well as his or her arm strength in conjunction with the force provided by the assistive seating device in lifting oneself to a standing position.

Figure 6:
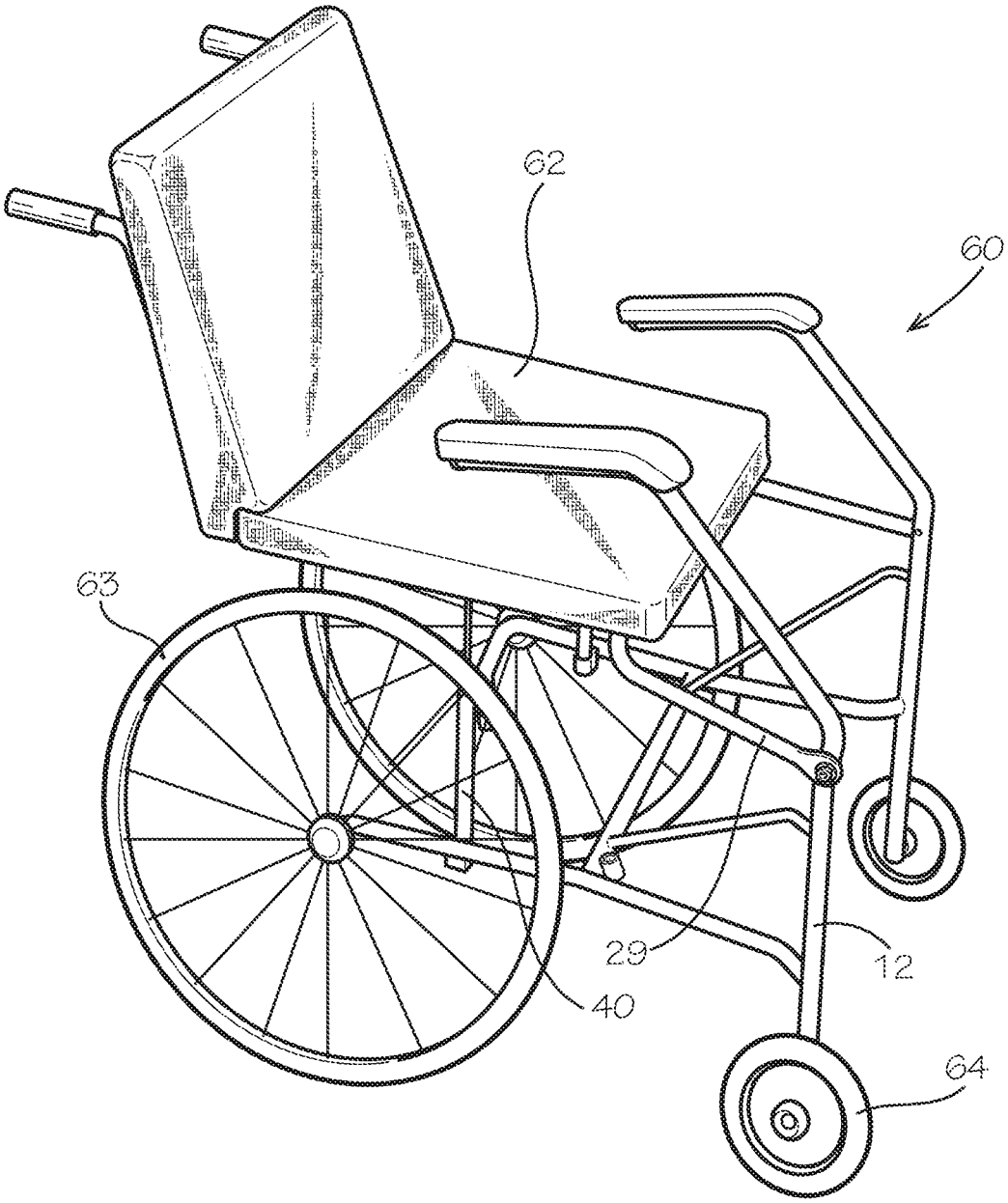
FIG. 6 is a perspective view of an assistive seating device in another preferred form of the invention.

With reference next to FIG. 6, which shows the invention in another preferred form. Here, the assistive seating device 60 is essentially the same as that of the previous embodiment except that it is in the form of a wheelchair. As such, the seat portion 29 includes a conventional cushioned seat 62 rather than the toilet seat 35. Additionally, the assistive seating device 60 includes a pair of large rear wheels 63 coupled to the rear legs 14, and a pair of small, pivotal front wheels 64 coupled to the front legs 15.

In use, the assistive seating device 60 operates in the same manner as previously described with the positioning of the lifting cylinders determining the lifting force upon the seat portion 29. Additionally, the armrests may be pushed upon to aid in lifting the person without affecting the lifting of the seat portion 29.

Figure 7:
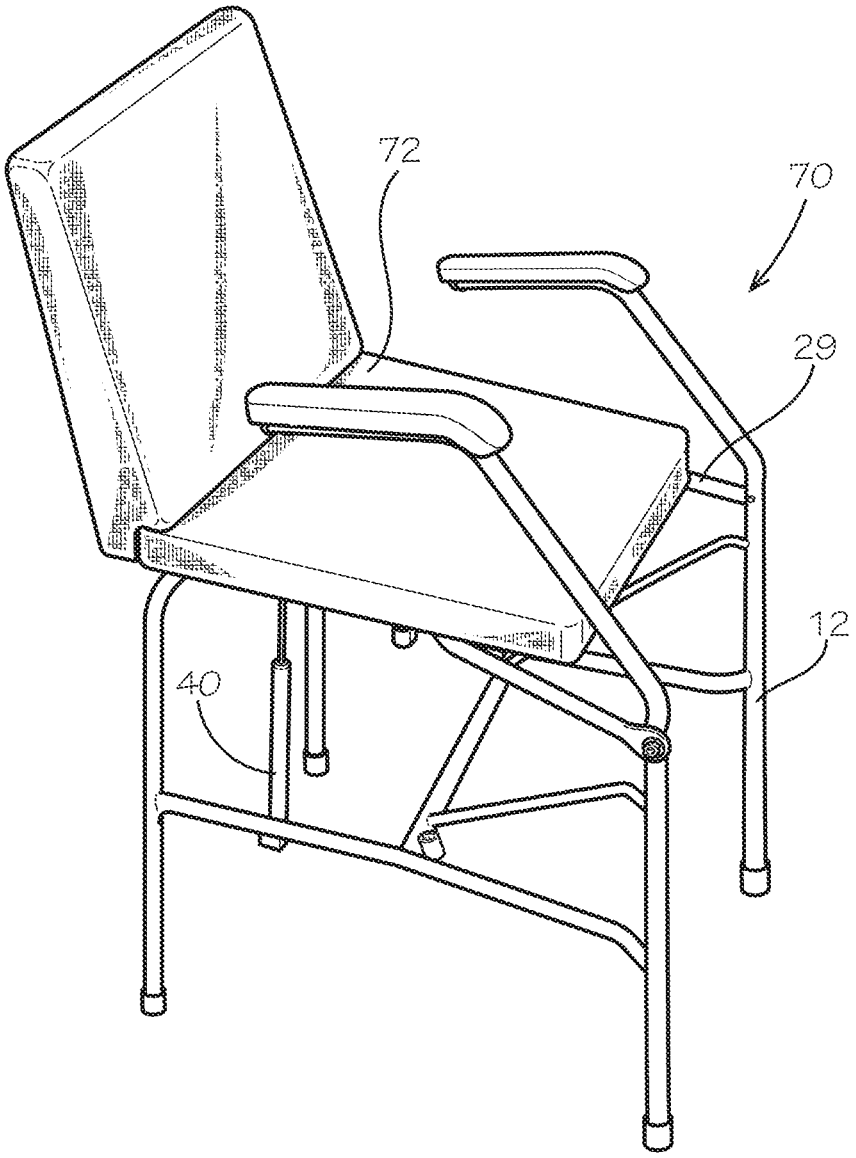
FIG. 7 is a perspective view of an assistive seating device in yet another preferred form of the invention.

With reference next to FIG. 7, which shows the invention in another preferred form. Here, the assistive seating device 70 is essentially the same as that of the previous embodiment of FIG. 1 except that it is in the form of a typical seating chair, such as a dining room chair, recliner, cushioned chair, or any other conventionally known chair. As such, the seat portion 29 includes a conventional cushioned seat 72 rather than the toilet seat 35.

In use, the assistive seating device 70 operates in the same manner as previously described with the positioning of the lifting cylinders determining the lifting force upon the seat portion 29. Additionally, the armrests may be pushed upon to aid in lifting the person without affecting the lifting of the seat portion 29.

It should be understood that the present invention may be incorporated into any seat, chair, couch, sofa, stool, car seat, examination table, or the like.

While this invention has been described in detail with particular reference to the preferred embodiment thereof and the best mode of practicing same, it will be understood that variations and modifications, in addition to those specifically recited, can be effected within the spirit and scope of the invention as described herein above and as set forth in the appended claims.

The invention claimed is:

1. An assistive seating device comprising, a base having a front having a pair of front legs and a rear having a pair of rear legs, said base including a pair of laterally disposed first couplers positioned adjacent said base rear and a pair of laterally disposed second couplers positioned adjacent said base front, said base also including a pair of laterally disposed stationary [arms] armrests extending from said front legs;

a seat portion pivotally coupled for reciprocal movement to said base, said seat portion including a pair of laterally disposed pivot mounts;

a pair of laterally disposed lifting cylinders, each lifting cylinder having one end pivotally coupled to said seat portion through one said pivot mount and an opposite end releasably coupled to either one said first coupler or one said second coupler, whereby the selective positioning of the lifting cylinders through the selective positioning of the opposite ends determines the lifting force of the lifting cylinders upon the seat portion, wherein the distance between each said pivot mount and a corresponding first coupler is generally equal to the distance between each said pivot mount and a corresponding second coupler.

2. An assistive seating device comprising, a frame having a base and a seat portion pivotally coupled to said base, said frame base having two rear legs, two front legs, two rear couplers, and two front couplers, said frame seat portion being pivotally coupled to said frame base through at least one pivot;

two lifting arms, each said lifting arm being directly coupled to one said front leg, and a pair of laterally disposed lifting cylinders, each lifting cylinder having an upper end pivotally coupled to said frame seat portion through a pivot mount and a lower end configured to be selectively coupled to one of said rear coupler or said front coupler, whereby the selective positioning of the lifting cylinders through the selective positioning of the lower ends determines the total lifting force of the lifting cylinders upon the seat portion, wherein the distance between each said pivot mount and a corresponding rear coupler is generally equal to the distance between each said pivot mount and a corresponding front coupler.

3. An assistive seating device comprising, a base having a pair of rear lower couplers adjacent a rear of said base and a pair of front lower couplers adjacent a front of said base;

a seat portion pivotally coupled for reciprocal movement to said base, said seat portion having a pair of upper pivot mounts, the distance between said upper pivot mounts and said pair of rear lower couplers being generally the same as the distance between said upper pivot mounts and said pair of front lower couplers;

a pair of laterally disposed lifting cylinders, each lifting cylinder having a first end coupled to said seat portion through said pivot mounts and a second end selectively coupled to said base at either one said rear lower coupler of said pair of rear lower couplers or one said front lower coupler of said pair of front lower couplers, whereby each lifting cylinder is selectively coupleable to the seat portion and the base at a plurality of different elevational angles which determines the lifting force of the lifting cylinders upon the seat portion, and whereby the distance between the pivots and the rear lower couplers and front lower couplers are the same so that a tilting of the seat portion does not occur should one lifting cylinder be coupled to a rear lower coupler and the other lifting cylinder be coupled to a front lower coupler.

4. The assistive seating device of claim 3 wherein said lifting cylinders have upper ends pivotally coupled to said seat portion and lower ends releasably mounted to said base at a plurality of locations to create said plurality of different elevational angles of said lifting cylinders.

5. The assistive seating device of claim 3 further comprising a lock extending between said base and said seat portion to prevent relative movement between said seat portion relative to said base.

6. The assistive seating device of claim 3 wherein said seat portion includes a seat in the form of a toilet seat.

7. The assistive seating device of claim 3 further comprising a plurality of wheels coupled to said base.

8. The assistive seating device of claim 3 wherein said base includes a pair of laterally disposed stationary arms.

* * * * *